US011891880B1

(12) United States Patent
Kharel et al.

(10) Patent No.: US 11,891,880 B1
(45) Date of Patent: Feb. 6, 2024

(54) INTELLIGENT AUTOMATED PREVENTION OF HIGH PRESSURE FLARE EVENTS

(71) Applicant: EOG Resources, Inc., Houston, TX (US)

(72) Inventors: Pratik Kharel, Houston, TX (US); Mark Xavier Metzger, Houston, TX (US); Michael Jiale Yang, Houston, TX (US); Andrew Michael Mealey, Houston, TX (US); Liz Mydung Thai, Pearland, TX (US)

(73) Assignee: EOG Resources, Inc., Houston, TX (US)

( * ) Notice: Subject to any disclaimer, the term of this patent is extended or adjusted under 35 U.S.C. 154(b) by 0 days.

(21) Appl. No.: 18/345,769

(22) Filed: Jun. 30, 2023

(51) Int. Cl.

| | |
|---|---|
| ***E21B 41/00*** | (2006.01) |
| ***E21B 35/00*** | (2006.01) |
| ***E21B 43/12*** | (2006.01) |
| ***E21B 47/06*** | (2012.01) |

(52) U.S. Cl.
CPC ..... *E21B 41/00* (2013.01); *E21B 35/00* (2013.01); *E21B 43/121* (2013.01); *E21B 47/06* (2013.01)

(58) Field of Classification Search
CPC ..... E21B 35/00; E21B 43/121; E21B 47/06
See application file for complete search history.

(56) References Cited

U.S. PATENT DOCUMENTS

| | | | | |
|---|---|---|---|---|
| 4,516,932 | A | 5/1985 | Chaudot | |
| 7,172,020 | B2 | 2/2007 | Tseytlin | |
| 9,115,566 | B2 | 8/2015 | Amudo | |
| 10,494,906 | B2 | 12/2019 | Nandola et al. | |
| 10,648,320 | B2 | 5/2020 | Burgstaller | |
| 2017/0356279 | A1* | 12/2017 | Nandola | E21B 41/00 |
| 2018/0023360 | A1* | 1/2018 | Flanders | E21B 34/00 166/53 |
| 2018/0209248 | A1* | 7/2018 | Patel | E21B 34/06 |
| 2021/0262327 | A1 | 8/2021 | Berland | |
| 2021/0348483 | A1* | 11/2021 | Organ | E21B 33/0355 |
| 2022/0389798 | A1 | 12/2022 | Liu et al. | |

FOREIGN PATENT DOCUMENTS

| | | | |
|---|---|---|---|
| CN | 111489090 | A | 8/2020 |

* cited by examiner

*Primary Examiner* — Brad Harcourt
(74) *Attorney, Agent, or Firm* — Baker Botts L.L.P.

(57) ABSTRACT

In one embodiment, a method for preventing flaring at a facility, by a system, includes receiving a plurality of pressure measurements from a sensor disposed downstream of the facility. The method further includes comparing the plurality of pressure measurements to a threshold pressure, wherein the threshold pressure corresponds to mitigating a flaring event. In response to determining that at least one of the plurality of pressure measurements is greater than the threshold pressure, the method further includes analyzing injection response curves for a plurality of wells to determine a first well for adjusting a back pressure on a reservoir intersected by the first well. The method further includes transmitting an instruction to the first well to adjust the back pressure on the reservoir.

20 Claims, 4 Drawing Sheets

INTELLIGENT AUTOMATED PREVENTION OF HIGH PRESSURE FLARE EVENTS

BACKGROUND

In oilfield systems with networks of pipelines, high line pressures can occur for a multitude of reasons. For example, backpressures in gathering lines further upstream may lead to a build-up of downstream pressures at a production facility. Once the production facility reaches a threshold pressure, it may become unsafe to continue operating the oilfield system without alleviating the excessive pressure.

One traditional solution to alleviating excessive pressures is to simply cease harvesting gas from a well, or "shutting down the well." However, shutting down the well is not a favorable decision to ameliorate pressures for various time, economic, and logistical considerations. For instance, shutting down the well often must occur at some time before downstream pressures reach their threshold levels due to the material properties of the gas and the distance between the well and production facility. In other words, although a certain volume of gas is extracted from the earth at the well, the corresponding line pressure resulting from the addition of said volume of gas is not recognized immediately. Further, shutting down (and subsequently re-starting) the well carries associated costs that ultimately reduce the profitability of well operations. For example, shutting down and re-starting the well in piecemeal fashion leads to nonoptimal production schedules. Finally, shutting down the well often requires field operators to react within minutes of the decision to shut down the well so as to avoid losses or, worse, safety hazards. As a result, the logistical considerations for shutting down the well can prove cumbersome.

Another common solution to alleviating excessive pressure in production facilities is through flare events. During a flare event, a volume of gas from within the oilfield system having excessively pressurized lines is released and/or combusted. The volume of gas released and/or combusted is generally proportional to the desired change in pressure required to alleviate the high line pressure. Similar to shutting down the well, flare events are an unfavorable solution for alleviating excessive pressure for various considerations. Of course, when a volume of gas is released from the system and possibly combusted upon release, the volume of gas is lost and can no longer be processed in the system. Also, flare events are particularly wasteful, since releasing and flaring gasses amounts to recognized unrecoverable losses in the refining process. Additionally, because flare events involve igniting the released excess fuel, additional systems and steps are further required to ensure the safety of the gas remaining in the line systems. Plus, releasing and flaring excess gas releases potentially avoidable emissions into the environment.

DETAILED DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

Figure 1:
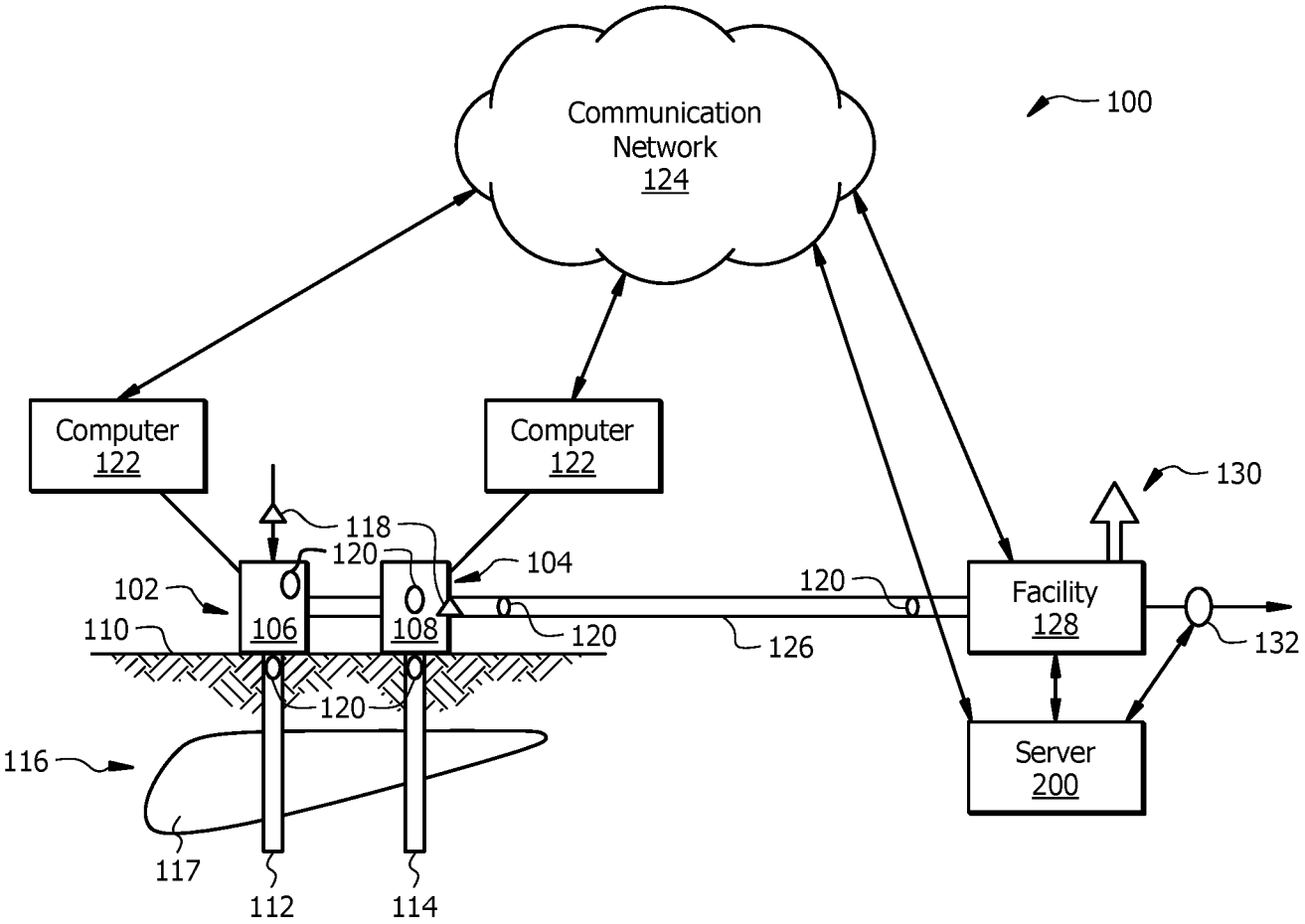
FIG. 1 is a schematic diagram of an example oilfield system, according to certain embodiments.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct engagement between the two devices, or through an indirect connection that is established via other devices, components, nodes, and connections. Similarly, the term "communicatively coupled" or "operatively connected" as used herein is intended to mean either a direct or an indirect communication connection. Such connection may be a wired or wireless connection such as, for example, Ethernet or LAN. Thus, if a first device communicatively couples to a second device, that connection may be through a direct connection, or through an indirect communication connection via other devices and connections.

As used herein, the term "at least one of" is synonymous with "one or more of". For example, the phrase "at least one of A, B, and C" means any one of A, B, and C, or any combination of any two or more of A, B, and C. For example, "at least one of A, B, and C" includes one or more of A alone; or one or more of B alone; or one or more of C alone; or one or more of A and one or more of B; or one or more of A and one or more of C; or one or more of B and one or more of C; or one or more of all of A, B, and C. For purposes of the description hereinafter, the terms "upper", "lower", "right", "left", "vertical", "horizontal", "top", "bottom", "lateral", "longitudinal", and derivatives thereof shall relate to the disclosure as it is oriented in the figures. However, it is to be understood that the disclosure may assume alternative variations and step sequences, except where expressly specified to the contrary. It is also to be understood that the specific devices and processes illustrated in the attached drawings and described in the following specification are simply exemplary aspects of the disclosure. Hence, specific dimensions and other physical characteristics related to the aspects disclosed herein are not to be considered as limiting.

In many oilfield systems, once oil or natural gases are extracted from subterranean formations, the gases are transported to various facilities for storage or refinement via pipelines. At times, the pressures in the pipelines exceed threshold parameters regulating the safety of the oilfield system. In order to alleviate the excess pressures, current systems either shut in the wells, vent, or flare excess gas, which negatively impact system productivity, economic efficiency, and the system's environmental footprint. Thus, a system and related method for intelligently sensing and reducing high line pressures is needed to prevent flare events or other events negatively impacting oilfield system productivity. The present invention satisfies this need by utilizing intelligent technology to prevent flare events. In particular, the present invention detects and analyzes data continually detected at a plurality of sensors located in various components of the oilfield system to iteratively determine whether to adjust back pressures or well production so as to optimize the system's production. The invention also may integrate various automated technologies, including but not limited to artificial intelligence or machine learning algorithms, to further optimize production. In one embodiment, the present invention may adjust back pressures or well production remotely, via a communication network communicatively connected to at least one server and at least a local computer that may control one or more of a plurality of wells.

FIG. 1 is a schematic diagram of an exemplary oilfield system 100 that may employ the principles of the present disclosure, according to one or more embodiments. As illustrated, the oilfield system 100 may include at least a first well 102 and a second well 104. Each one of the first well 102 and second well 104 may comprise a drilling platform 106, 108 (respectively) positioned at a surface 110 configured to facilitate drilling one or more wellbores below the surface 110. At least one wellbore may correspond to the first well 102 and the second well 104, such as a first wellbore 112 and a second wellbore 114, respectively. The first wellbore 112 and the second wellbore 114 may extend into and/or through one or more subterranean formations 116 having at least one reservoir 117 of subterranean fluids. In embodiments, each one of the first well 102 and the second well 104 may comprise at least one choke valve 118 for regulating the flow of injection fluids or subterranean fluids to and/or from the subterranean formations 116, wherein regulation of the flow of subterranean fluids may be related to pressure. In embodiments, the first well 102 may be an injection well, such that liquids or other substances may be injected through the first wellbore 112 into the subterranean formation(s) 116 to facilitate further extraction of materials from the subterranean formation (s) 116 at the second well 104. The second well 104 may be a production well, such that oil or natural gases may be extracted from the subterranean formation(s) 116. In other embodiments, the first well 102 may be the production well and the second well 104 may be the injection well.

Each of the first well 102 and second well 104 may include numerous sensors 120 and may be configured to receive and transmit data corresponding to well operation of the wells 102/104 via at least one operatively connected computer 122, wherein each computer 122 may be locally disposed in relation to the first and second wells 102, 104. The computer 122 may include a general purpose I/O interface with various wired or wireless user-input methods, such as a touch screen, a keyboard and/or mouse, and various peripherals that may not be within the physical vicinity of the computer 122 but are nonetheless communicatively coupled to the computer 122. In some cases, the first and/or second wells 102, 104 may be configured to transmit well injection or production data, such as gas injection rate, number of barrels extracted from the subterranean formation(s) 116, and others. In other possible embodiments, the first and/or second wells 102, 104 may receive instructions from various devices or communication networks communicatively connected to the respective computer 122, wherein one or more of the first and second wells 102, 104 may responsively perform the received instructions to achieve a desired condition. Each computer 122 corresponding to the first and/or second well 102, 104 may be operatively connected to a communication network 124. The communication network 124 may be a cloud-based network that may facilitate the transmission of data between components of the oilfield system 100. The communication network 124 may also receive, store, and transmit data and instructions across the various components of oilfield system 100.

In embodiments, each of the first and/or second wells 102, 104 may be operatively connected to a network of pipelines 126 that transport injection fluids and/or extracted oil or natural gases between various other components of oilfield system 100, such as a facility 128. There may be one or more sensors 120 disposed throughout the network of pipelines 126, and each of the one or more sensors 120 may be configured to measure a parameter of the extracted oil and/or natural gases as the fluids flow therethrough.

As shown, the facility 128 may be disposed downstream from the first and/or second wells 102, 104. The facility 128 may receive the extracted oil and/or natural gases via the network of pipelines 126. Various other pipelines within the network of pipelines 126 may exist, such as gas gathering lines and/or flowlines, and the various other pipelines may be disposed at or around the facility 128. These various other pipelines within the network of pipelines 126 may also be operatively connected to the other various components of the oilfield system 100 and may be used to transport materials to or from the first well 102, to or from the second well 104, or to or from the facility 128. The facility 128 may comprise a flare system 130, where excess volumes of gas may be transported from the oilfield system 100 and released therefrom to an external environment. Flare system 130 may combust the excess volumes of gas upon release.

A facility check meter 132 may be disposed downstream of the facility 128. In embodiments, the facility check meter 132 may measure the pressure of the discharged fluids from the facility 128 in real-time. The facility check meter 132 may be communicatively connected to the communication network 124 and may transmit pressure measurements from a portion of the network of pipelines 126 downstream of the facility 128 to the communication network 124, wherein the communication network 124 may then transmit the received pressure measurements to a server 200 associated with the facility 128. In other embodiments, the facility check meter 132 may transmit the pressure measurements directly to the server 200.

In embodiments, the server 200 may be disposed remotely from, or locally in relation to, the facility 128. The server 200 may be communicatively coupled to the communication network 124 and may receive data, store data, or otherwise perform analyses for optimizing the efficiency of oilfield system 100 such that flare events are minimized. The server 200 may determine whether to send instructions to at least one of the computers 122 to adjust the performance of the communicatively coupled first and/or second wells 102, 104. The determination for sending instructions may be based, at least in part, on various inflow performance relationship (IPR) and vertical lift performance (VLP) curves. An IPR curve may be a graphical representation of the relationship between the rates that subterranean fluids can be supplied from a subterranean reservoir at a given flowing pressure. IPR curves may also graphically represent the pressure of wellbore 114 at the surface 110 for a particular flow rate. IPR curves may be used to analyze and/or predict reservoir pressures at the subterranean formation(s) 116 and/or flow rates under various circumstances. A VLP curve may be a graphical representation of the pressure losses that occur in the vertical extraction of fluids from subterranean formation(s) 116 through the wellbore 114.

Together with an IPR curve, a VLP curve may be utilized to analyze and/or adjust the operation of the components of oilfield system 100 in order to further optimize performance of the first well 102 and/or the second well 104.

While FIG. 1 illustrates a singular server 200, the present disclosure may include usage of additional servers 200. The server(s) 200 may receive data corresponding to operations at first wellbore 112 and second wellbore 114. The server(s) 200 may also receive pressure measurements from the facility check meter 132 via the communication network 124. The server(s) 200 may be configured to use the received operations data to determine and/or analyze IPR and VLP curves for the second well 104 based on the received data. In embodiments, the server(s) 200 may compare the reading to a stored threshold pressure (such as threshold pressure 208 in FIG. 2) and determine whether the reading exceeds the stored threshold pressure. The server 200 may then calculate and/or determine an injection or production response for the first well 102 and/or the second well 104 based on the IPR curve and/or VLP curve. The IPR curve and/or VLP curve upon which the server 200 bases its injection or production response may be uploaded to the server 200 or may be inferred using a set of uploaded parameters and various integrated machine learning or adaptive intelligence algorithms. In embodiments, the server(s) 200 may repeat the aforementioned analysis, making calculations and/or determinations for each one of a plurality of first wells 102 or second wells 104.

The server(s) 200 may then determine that performance adjustment is necessary for one of the plurality of first wells 102 and/or second wells 104 and may subsequently provide an instruction to the communicatively connected computer 122 via the communication network 124 instructing the first and/or second well(s) 102, 104 to adjust performance in furtherance of reducing backpressures on the subterranean formation(s) 116. In embodiments, the first well 102 may reduce injection rates via restricting flow of injection fluids through at least one choke valve 118. In embodiments, the second well 104 may adjust oil and/or natural gas extraction rates via restricting outflow of subterranean fluids through at least one choke valve 118. In embodiments, the responsive performance of the components of the first well 102 and/or the second well 104, such as the use of choke valve(s) 118, reduces excessive line pressures without needing to shut down any of the first and/or second wells 102, 104 or flare any volumes of gas. In embodiments, the analysis of the facility check meter 132 may be dynamic, and the preferred embodiment of the invention may utilize other methods of machine learning or adaptive intelligence to predictively analyze when no further well adjustments are needed.

Even though FIG. 1 depicts a land-based well, it will be appreciated that the embodiments of the present disclosure are equally well suited for use in other types of drilling platforms, such as offshore platforms, or rigs used in any other geographical locations. Similarly, it will be appreciated that the present disclosure contemplates that either one of the first or second wellbore 112, 114 may be vertical, horizontal or at any deviation. As illustrated, FIG. 1 shows a singular first well 102 and a second well 104, but the present disclosure is not limited to this depiction. In embodiments, there may be a plurality of injection wells and/or production wells operationally configured in similar manners to each of the first and/or second wells disclosed herein 102, 104. For example, oilfield system 100 may comprise two or more injection wells and one production well. In other examples, however, oilfield system 100 may comprise one injection well and two or more production well. Similarly, this disclosure contemplates a first and second well 102, 104 that may be arranged in any operative configuration relative to the subterranean formation(s) 116.

Figure 2:
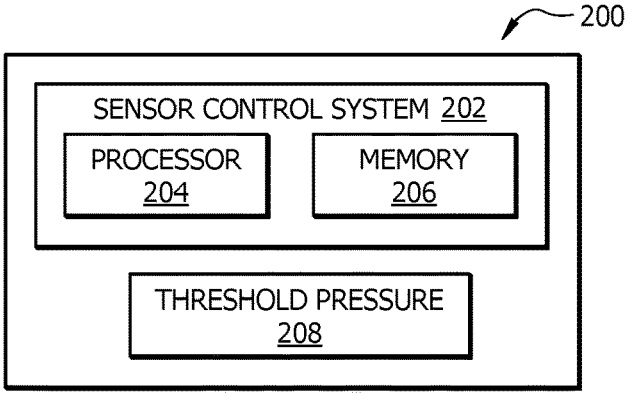
FIG. 2 is a diagram of an exemplary server, according to certain embodiments.

FIG. 2 illustrates a block diagram of the server 200 of oilfield system 100 (referring to FIG. 1), in accordance with embodiments of the present disclosure. In certain embodiments, several servers 200 may be present. Further, server(s) 200 may contain any suitable number of databases and machine learning algorithms contained thereon, including those supporting adaptive intelligence capabilities. Server(s) 200 may be communicatively coupled to the communication network 124 (referring to FIG. 1) such that information processed by the server(s) 200 may be conveyed to the various components of the oilfield system 100, such as the network of pipelines 126 (referring to FIG. 1), computers 122 (referring to FIG. 1), the first well 102 (referring to FIG. 1), or the second well 104 (referring to FIG. 1). The server(s) 200 may comprise a sensor control system 202, a processor 204, a memory 206, and a threshold pressure 208, all of which are described in further detail below.

Sensor control system 202 may be a conventional sensor control system for processing or executing determinations and analyses of data sent to server(s) 200 and may include standard components, such as processor 204 and memory 206. Control data to and from the server 200 and its various components, including the sensor control system 202, may be transmitted through the communication network 124, which may receive information from the other various components of oilfield system 100. The control data, which includes processes and instructions for the various components of the oilfield system 100, may also instruct the server(s) 200 to compare the plurality of pressure measurements to the threshold pressure 208 and analyze IPR and VLP curves to determine a first target component of system 100 for increasing back pressures on subterranean formation(s) 116 (referring to FIG. 1). Further, process data and instructions may include user-inputted information regarding the operation of oilfield system 100 (referring to FIG. 1), such as the threshold pressure 208. In embodiments, the threshold pressure 208 may be, for example, a particular pressure value, such as 160 pounds per square inch (psi); a pressure gradient, such as a rate of change of pressure measured at the facility check meter 132 (referring to FIG. 1) over time; or both.

In certain embodiments, server(s) 200 may be configured to use information from at least one sensor 120 (referring to FIG. 1) to operate one or many machine learning algorithms, including, but not limited to, artificial neural network, random forest, gradient boosting, support vector machine, or kernel density estimator to execute the aforementioned processes.

In embodiments, processor 204 may include, for example, a microprocessor, microcontroller, digital signal processor (DSP), application specific integrated circuit (ASIC), or any other digital or analog circuitry configured to interpret and/or execute program instructions and/or process data. In some embodiments, processor 204 may be communicatively coupled to memory 206. Processor 204 may be configured to interpret and/or execute non-transitory program instructions and/or data stored in memory 206. Program instructions or data may constitute portions of software for carrying out anomaly detection, as described herein. The processor 204 of may compare the plurality of pressure measurements to the threshold pressure 208. In embodiments, the server(s) 200 may receive the threshold pressure 208 from user input or may predictively calculate the threshold pressure 208 using various machine learning algorithms and/or adaptive intelligence capabilities supported on the server(s) 200. The various machine learning algorithms, adaptive intelligence capabilities, and user uploaded information may be stored in the memory 206 of the server(s) 200, and accessible as non-transitory machine-readable media by the processor 204. Further, the processor 204 may access the non-transitory machine-readable media to determine multiphase IPR and/or VLP curves for one or more of the first well 102 and/or second well 104. Similarly, the processor 204 may utilize the non-transitory machine-readable media to calculate an injection response curve based on the determined multiphase IPR and VLP curves for each of the wells. In embodiments, the processor may utilize the non-transitory machine-readable media to determine instructions for adjusting the back pressures present in the oilfield system 100 using at least one of the choke valves 118 (referring to FIG. 1).

Memory 206 may include any system, device, or apparatus configured to hold and/or house one or more memory modules; for example, memory 206 may include read-only memory, random access memory, solid state memory, or disk-based memory. Each memory module may include any system, device or apparatus configured to retain program instructions and/or data for a period of time, such as computer-readable non-transitory media. Process data and instructions may also be stored in memory 206. These data may include at least the threshold pressure 208 that may be compared to the plurality of pressure measurements observed at the facility check meter 132. For the purposes of this disclosure, computer-readable media may include any instrumentality or aggregation of instrumentalities that may retain data and/or instructions for a period of time. Computer-readable media may include, for example, without limitation, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such as wires, optical fibers, microwaves, radio waves, and other electromagnetic and/or optical carriers; and/or any combination of the foregoing.

Modifications, additions, or omissions may be made to FIG. 2 without departing from the scope of the present disclosure. For example, FIG. 2 shows a particular configuration of components for server(s) 200. However, any suitable configurations of components may be used. For example, components of server(s) 200 may be implemented either as physical or logical components. Furthermore, in some embodiments, functionality associated with components of server(s) 200 may be implemented in special purpose circuits or components. In other embodiments, functionality associated with components of server(s) 200 may be implemented in a general purpose circuit or components of a general purpose circuit. For example, components of server(s) 200 may be implemented by computer program instructions. The server 200 or components thereof may be located onsite, offsite, or in some combination of both locations (for example, and without limitation, certain components could be disposed onsite and certain components could be offsite, where the onsite components are communicatively coupled to the offsite components) with respect to the facility 128 (referring to FIG. 1).

Figure 3:
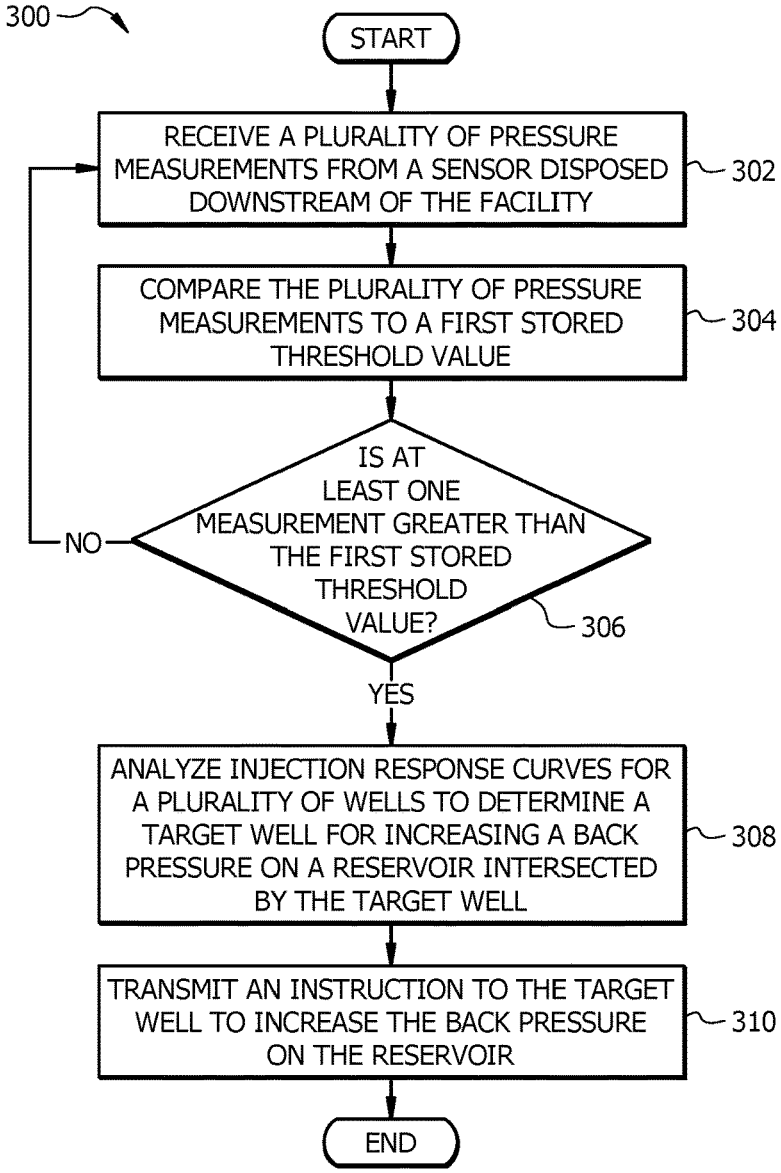
FIG. 3 is a flow diagram illustrating an example operation of the oilfield system of FIG. 1, according to certain embodiments.

FIG. 3 is a flow chart describing a method of operation 300 of the oilfield system 100 of FIG. 1. The general purpose of the method may relate to intelligently reducing the number of flare events of oilfield system 100, reducing high line pressures in the network of pipelines 126 (referring to FIG. 1), or both. The method 300 may begin at step 302, where the processor 204 (referring to FIG. 2) of the server(s) 200 (referring to FIGS. 1-2) receives a plurality of pressure measurements observed at the facility check meter 132 (referring to FIG. 1) disposed downstream of the facility 128 (referring to FIG. 1). The plurality of pressure measurements observed at the facility check meter 132 may be indicative of the operational conditions of the oilfield system 100, such as the operational conditions at the first well 102 (referring to FIG. 1), the second well 104 (referring to FIG. 1), or the network of pipelines 126.

At step 304, the processor 204 of the server(s) 200 may compare the plurality of pressure measurements to the threshold pressure 208 (referring to FIG. 2) stored in the memory 206 (referring to FIG. 2). In embodiments, the server(s) 200 may receive the threshold pressure 208 from user input or may predictively calculate the threshold pressure 208 using various machine learning algorithms and/or adaptive intelligence capabilities supported on the server(s) 200. The various machine learning algorithms, adaptive intelligence capabilities, and user uploaded information may be stored in the memory 206 of the server(s) 200, and accessible as non-transitory machine-readable media by the processor 204. Further, the processor 204 may access the non-transitory machine-readable media to determine multiphase IPR and/or VLP curves for one or more of the first well 102 and/or second well 104. Similarly, the processor 204 may utilize the non-transitory machine-readable media to calculate an injection response curve based on the determined multiphase IPR and VLP curves for each of the wells. In embodiments, the processor may utilize the non-transitory machine-readable media to determine instructions for adjusting the back pressures present in the oilfield system 100 using at least one of the choke valves 118 (referring to FIG. 1).

At step 306, the processor 204 of the server(s) 200 may utilize the data available to it to determine whether any of the plurality of pressure measurements are greater than the threshold pressure 208. If any of the plurality of pressure measurements are lower than the corresponding threshold pressure values, such as the threshold pressure 208, then the method may return to step 302 for further receipt of subsequent pressure measurements from the facility check meter 132. If, on the other hand, any of the plurality of pressure measurements are greater than the corresponding threshold pressure values, such as the threshold pressure 208, then the method continues to step 308.

At step 308, the processor 204 of the server(s) 200 may analyze determined IPR and/or VLP curves for each of the first well 102 and/or second well 104 to determine a target well for increasing a back pressure on a reservoir intersected by the target well. In certain embodiments, the target well may be the first well 102 or second well 104. Once a target well is identified, the processor 204 of server(s) 200 may then predictively determine an injection response curve based on present or similar previous conditions in the oilfield system 100. Based on the data determined in the injection response curve, the processor 204 may then produce an instruction for adaptively adjusting the various components of the target well to alleviate the excessive pressure.

At step 310, the processor 204 of the server(s) 200 may transmit the instruction to the determined target well (or to the computer 122 (referring to FIG. 1) corresponding to said target well) via communication network 124 (referring to FIG. 1) such that the target well may responsively adjust operation in such a way that back pressures on the reservoir are increased. Without limitations, the responsive adjustments in operation may take a variety of forms, including but not limited to: reductions in fluid injection rates, utilization of one or more choke valves 118 to reduce the flow of injection fluid downhole of the target well, or utilization of one or more choke valves 118 to reduce outflow from the said target well to the network of pipelines 126.

Figure 4A:
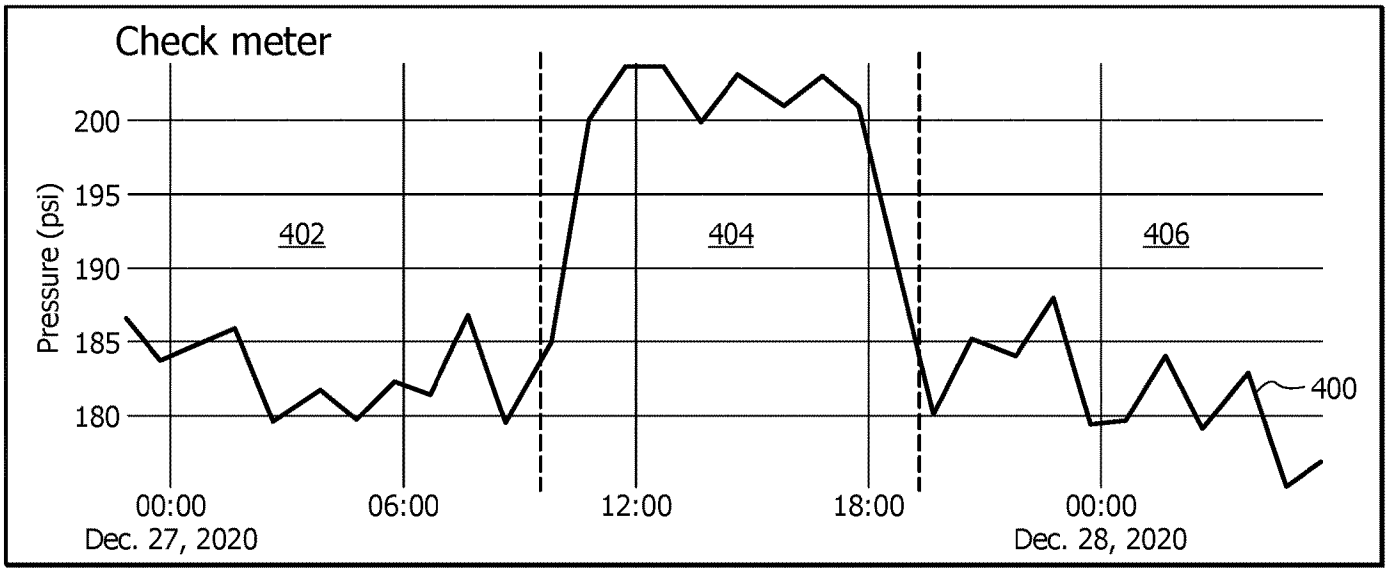
FIG. 4A is a graphical representation of the pressures measured at a facility check meter in FIG. 1 over a time period, according to certain embodiments.
Figure 4B:
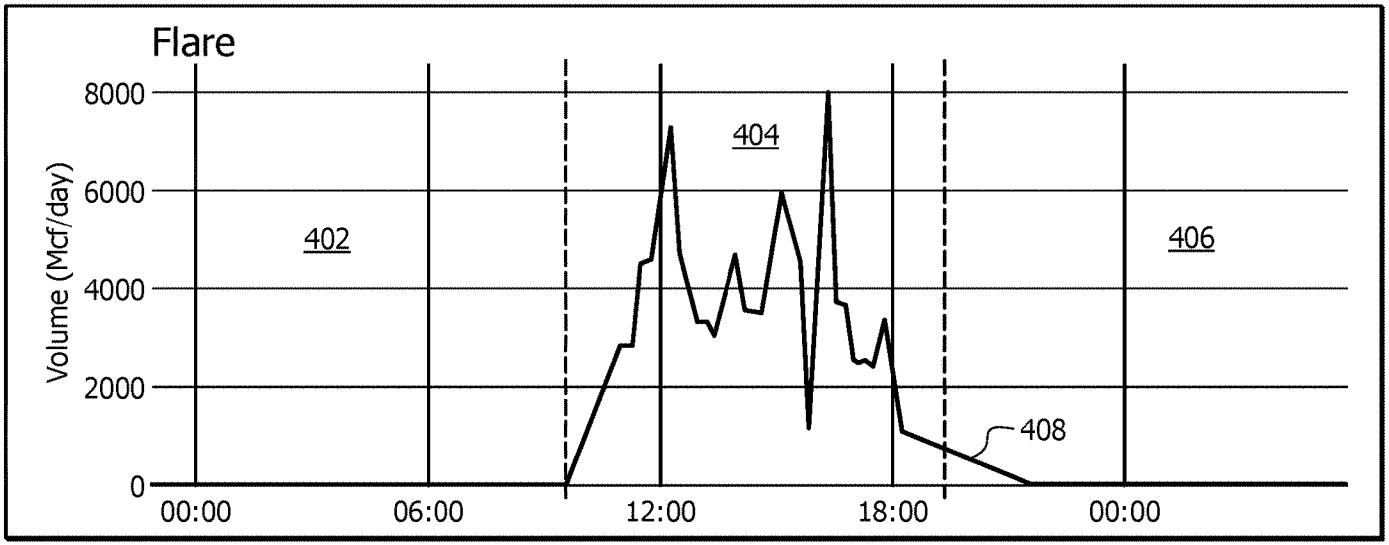
FIG. 4B is a graphical representation of flare volumes over the time period of FIG. 4A, according to certain embodiments.

FIGS. 4A and 4B illustrate a present embodiment of gas processing facilities without implementing mitigation techniques, such as through the utilization of flare events. FIG. 4A illustrates a signal 400 showing the measured pressure over a 24-hour span from facility check meter 132 (referring to FIG. 1) disposed downstream of the facility 128 (referring to FIG. 1). In particular, the signal 400 shows a first time period 402, a second time period 404, and third time period 406. In the first time period 402, the measured pressure varies between approximately 179 and 188 pounds per square inch ("psi"). During the second time period 404, the measured pressure notably increases to exceed a predetermined threshold pressure level (not shown). The predetermined threshold pressure level can be uploaded as a particular pressure (i.e., 191 psi), as a rate of change of pressure over time (i.e., change of psi per hour over 10), or both. In the second time period 404 of FIG. 4A, the measured pressure settles at approximately 200 psi. Later in the second time period 404, the pressure decreases back to levels lower than the approximately 200 psi levels and similar to the pressure levels measured during the first time period 402. In the third time period 406, the pressure returns to fluctuate between approximately 179 and 188 psi, or lower. The exact values provided herein are merely exemplary, and one of ordinary skill in the art will appreciate that other pressure measurement values may be observed depending on the particular arrangements of pipelines and systems similar to oilfield system 100 (referring to FIG. 1).

FIG. 4B illustrates a signal 408 showing the volume of gas flared over the same 24-hour span in units of thousand-cubic-feet per day. As shown in the FIG. 4B, the amount of gas flared per day is zero through the first time period 402, during which the pressure varies between approximately 179 and 188 psi. When the measured pressure exceeds the predetermined threshold, during the second time period 404, the system will begin to flare a volume of gas proportional to the system reduces the high line pressures. The precise volume of gas flared is determined dynamically with reference to the IPR and VLP curves and other resources and practices conventionally known in the art. Once the measured pressure shown in FIG. 4A returns below a predetermined threshold, which may be the same predetermined threshold previously mentioned, the oilfield system 100 (referring to FIG. 1) ceases to flare gas and the system returns to its normal operating state in the third time period 406.

Figure 5A:
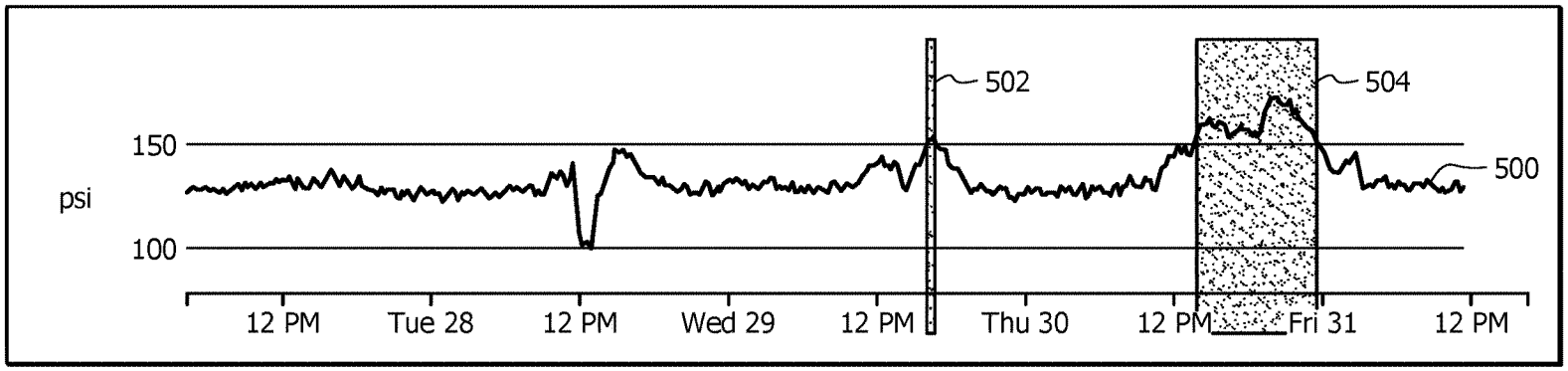
FIG. 5A is a graphical representation of the pressure measured at a facility check meter of FIG. 1 over a time period, according to certain embodiments.
Figure 5B:
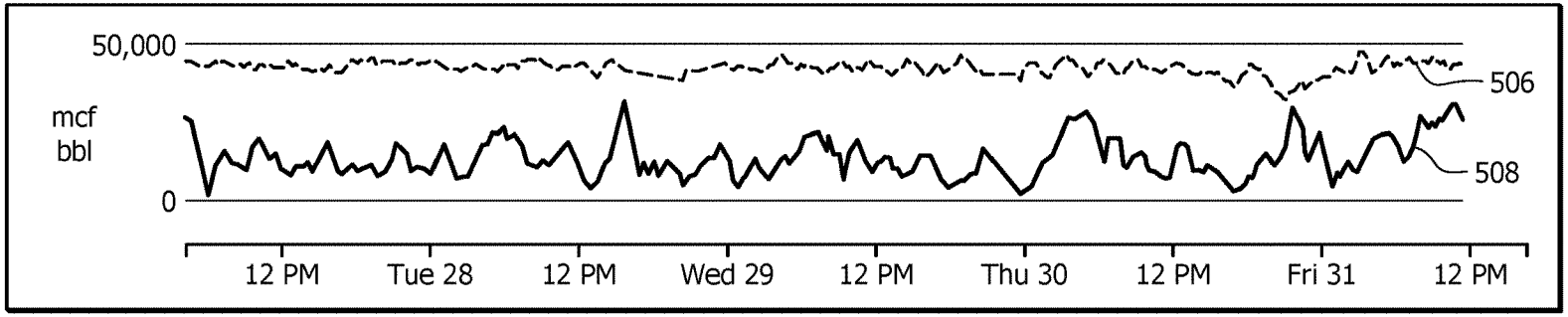
FIG. 5B is a graphical representation of reservoir gas measured in thousand-cubic-feet (mcf) and oil production in barrels over the same time period as FIG. 5A, according to certain embodiments.
Figure 5C:
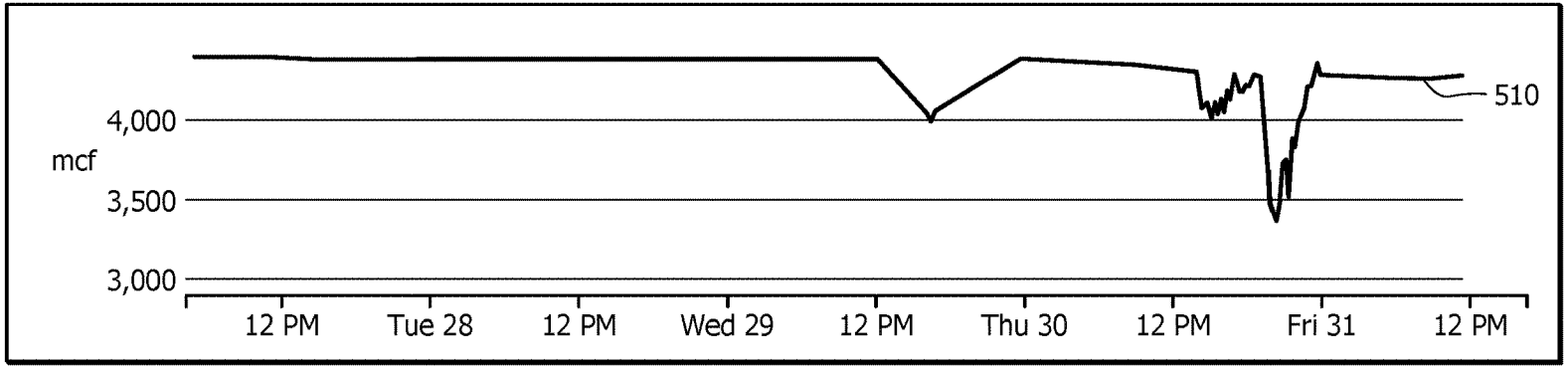
FIG. 5C is a graphical representation of injection gas injected into a wellbore of an injection well of FIG. 1, measured in mcf, over the same time period as FIG. 5A, according to certain embodiments.

FIGS. 5A-5C depict the effects of a practical embodiment of the present invention in the oilfield system 100 (referring to FIG. 1) over the same time period. FIG. 5A shows a signal 500 corresponding to the pressure measurements from the facility check meter 132 (referring to FIG. 1). FIG. 5A also features two areas, a first area 502 and a second area 504, of varying widths signifying the times during which the pressure measured at the facility check meter 132 exceeds a predetermined threshold pressure. The first and second areas 502, 504 correspond to time periods during which flare events may be employed in order to alleviate the excessive pressures. During the first area 502, the pressure measured at the facility check meter 132 briefly exceeds the threshold pressure before quickly returning below the threshold. During the second area 504, however, the threshold pressure is exceeded for a longer period of time. During each of the first and second areas 502, 504, when the threshold pressure is exceeded, an embodiment of the invention evaluates the difference between measured pressures at the facility check meter 132 and the threshold pressure values, such as threshold pressure 208 (referring to FIG. 2). As part of the evaluation of the difference, the present invention may analyze the pressure difference with reference to IPR and VLP curves and other resources conventionally known in the art.

FIG. 5B depicts two signals over the same time period—the amount of gas (thousands of cubic feet, or mcf) in the reservoir 506 and the number of barrels of oil produced 508. As shown in FIG. 5B, signal 506 fluctuates over time and may or may not be influenced by excessive pressures at the facility check meter 132 (referring to FIG. 1). Generally, however, lower values of signal 506 correspond to lower pressures measured at the facility check meter 132. For example, FIG. 5B shows that when the pressure at facility check meter 132 is excessive (i.e., the second area 504 of FIG. 5A), system signal 506 (i.e., the amount of gas present in the oilfield system 100) decreases.

FIG. 5C illustrates a signal 510 corresponding to the amount of gas (mcf) injected into the at least one of the first wells 102 (referring to FIG. 1) over the same time period. In an embodiment, an amount of injection gas may be injected into the first well 102, which may be an injection well, for a number of reasons related to optimizing the extraction of natural gas liquids from the ground. Typically, injection gasses boost production of the second well 104 (referring to FIG. 1), which may be a production well, so the amount of gas injected into the at least one well may be inversely related to the pressures measured at the facility check meter 132 (referring to FIG. 1) and the amount of gas present in the network of pipelines 126 (referring to FIG. 1). For example, as shown in FIG. 5C, during the times where signal 500 (referring to FIG. 5A) is in the first area 502 (referring to FIG. 5A) or second area 504 (referring to FIG. 5A), signal 510 reflects a reduction of gas injected into the first well 102 relative to the necessity of alleviating the excessive pressures measured at the facility check meter 132. During the second area 504 of FIG. when the measured pressure at the facility check meter 132 initially exceeds threshold pressure levels, the signal 510 may reflect a reduction by only a relatively small amount such that the pressure measured at facility check meter 132 does not return to below-threshold levels. As a result, the signal 510 indicates the possible further reduction until measured pressures at the facility check meter 132 drop below threshold levels. Once this recovery is established and pressures at the facility check meter 132 return to below-threshold levels, the signal 510 reflects a subsequent increase in higher injection rates, similar to those observed in signal 500 of FIG. 5A outside the first and second areas 502 and 504.

What is claimed is:

1. A method for preventing flaring at a facility, comprising:

receiving a plurality of pressure measurements from a sensor disposed downstream of the facility;

comparing the plurality of pressure measurements to a threshold pressure, wherein the threshold pressure corresponds to mitigating a flaring event;

in response to determining that at least one of the plurality of pressure measurements is greater than the threshold pressure, analyzing injection response curves for a plurality of wells to determine a first well for adjusting a back pressure on a reservoir intersected by the first well; and transmitting an instruction to the first well to adjust the back pressure on the reservoir.

2. The method of claim 1, wherein the instruction to the first well is to increase the back pressure on the reservoir.

3. The method of claim 1, further comprising:

determining a multiphase inflow performance relationship (IPR) curve for each one of the plurality of wells; and determining a vertical lift performance (VLP) curve for each one of the plurality of wells.

4. The method of claim 3, further comprising calculating an injection response curve based on the multiphase IPR curve and the VLP curve for each one of the plurality of wells.

5. The method of claim 1, wherein the threshold pressure is about 160 psi.

6. The method of claim 1, further comprising increasing the back pressure on the reservoir via one or more choke valves.

7. The method of claim 1, further comprising increasing the back pressure on the reservoir by reducing an injection flow rate at the first well, wherein the reduction in the injection flow rate at the first well corresponds to an increase in the back pressure on the reservoir.

8. A non-transitory computer-readable medium comprising instructions that, when executed by a processor, cause the processor to:

receive a plurality of pressure measurements from a sensor disposed downstream of a facility;

compare the plurality of pressure measurements to a threshold pressure, wherein the threshold pressure corresponds to mitigating a flaring event;

in response to determining that at least one of the plurality of pressure measurements is greater than the threshold pressure, analyze injection response curves for a plurality of wells to determine a first well for adjusting a back pressure on a reservoir intersected by the first well; and transmit an instruction to the first well to adjust the back pressure on the reservoir.

9. The non-transitory computer-readable medium of claim 8, wherein the instructions further cause the processor to:

wherein the instruction to the first well is to increase the back pressure on the reservoir.

10. The non-transitory computer-readable medium of claim 8, wherein the instructions further cause the processor to:

determine a multiphase inflow performance relationship (IPR) curve for each one of the plurality of wells; and determine a vertical lift performance (VLP) curve for each one of the plurality of wells.

11. The non-transitory computer-readable medium of claim 10, wherein the instructions further cause the processor to:

calculate an injection response curve based on the multiphase IPR curve and the VLP curve for each one of the plurality of wells.

12. The non-transitory computer-readable medium of claim 8, wherein the threshold pressure is about 160 psi.

13. The non-transitory computer-readable medium of claim 8, wherein the instructions further cause the processor to:

increase the back pressure on the reservoir via one or more choke valves.

14. The non-transitory computer-readable medium of claim 8, wherein the instructions further cause the processor to:

increase the back pressure on the reservoir by reducing an injection flow rate at the first well, wherein the reduction in the injection flow rate at the first well corresponds to an increase in the back pressure on the reservoir.

15. A system, comprising:

a facility configured to receive and process a flow of a fluid;

a sensor disposed downstream of the facility and configured to measure a pressure of the fluid as the fluid is discharged from the facility; and a server, comprising:

a memory configured to store a threshold pressure corresponding to mitigating a flaring event; and a processor operably coupled to the memory and configured to:

receive a plurality of pressure measurements from the sensor;

compare the plurality of pressure measurements to the threshold pressure;

in response to determining that at least one of the plurality of pressure measurements is greater than the threshold pressure, analyze injection response curves for a plurality of wells to determine a first well for adjusting a back pressure on a reservoir intersected by the first well; and transmit an instruction to the first well to adjust the back pressure on the reservoir.

16. The system of claim 15, wherein the processor is further configured to:

determine a multiphase inflow performance relationship (IPR) curve for each one of the plurality of wells; and determine a vertical lift performance (VLP) curve for each one of the plurality of wells.

17. The system of claim 16, wherein the processor is further configured to:

calculate an injection response curve based on the multiphase IPR curve and the VLP curve for each one of the plurality of wells.

18. The system of claim 15, wherein the processor is further configured to:

increase the back pressure on the reservoir via one or more choke valves.

19. The system of claim 15, wherein the processor is further configured to:

increase the back pressure on the reservoir by reducing an injection flow rate at the first well, wherein the reduction in the injection flow rate at the first well corresponds to an increase in the back pressure on the reservoir.

20. The system of claim 15, wherein the threshold pressure is about 160 psi.

* * * * *